US010018965B2

(12) United States Patent
Christan et al.

(10) Patent No.: US 10,018,965 B2
(45) Date of Patent: Jul. 10, 2018

(54) METHOD FOR ATTACHMENT OF A BALANCE SPRING FOR A MECHANICAL TIMEPIECE MOVEMENT AND BALANCE SPRING ATTACHED BY SUCH A METHOD

(71) Applicant: ETA SA Manufacture Horlogere Suisse, Grenchen (CH)

(72) Inventors: Julien Christan, Bienne (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 97 days.

(21) Appl. No.: 15/298,498

(22) Filed: Oct. 20, 2016

(65) Prior Publication Data

US 2017/0248918 A1 Aug. 31, 2017

(30) Foreign Application Priority Data

Feb. 25, 2016 (EP) ..... 16157390

(51) Int. Cl.

| | |
|---|---|
| ***G04B 17/32*** | (2006.01) |
| ***G04B 17/34*** | (2006.01) |
| ***G04B 17/06*** | (2006.01) |

(52) U.S. Cl.

CPC ..... *G04B 17/34* (2013.01); *G04B 17/063* (2013.01); *G04B 17/325* (2013.01)

(58) Field of Classification Search

CPC .... G04B 17/063; G04B 17/066; G04B 17/32; G04B 17/325; G04B 17/34

See application file for complete search history.

(56) References Cited

U.S. PATENT DOCUMENTS

| | | | | |
|---|---|---|---|---|
| 5,294,097 | A * | 3/1994 | Thomsen | F16F 1/10 185/45 |
| 6,116,774 | A | 9/2000 | Sasaki et al. | |
| 2015/0177689 | A1* | 6/2015 | Capt | G04B 17/325 368/178 |
| 2016/0147196 | A1* | 5/2016 | Villard | G04B 13/026 368/127 |

FOREIGN PATENT DOCUMENTS

| | | |
|---|---|---|
| CH | 571733 | 1/1976 |
| EP | 0 853 094 A1 | 7/1998 |
| FR | 2 255 648 | 7/1975 |
| FR | 2 283 475 | 3/1976 |
| JP | 2015-179071 | 10/2015 |
| WO | WO 2014/023584 A1 | 2/2014 |

OTHER PUBLICATIONS

European Search Report dated Aug. 17, 2016 in European Application 16157390.2 filed Feb. 25, 2016 (with English Translation of Categories of cited documents & Written Opinion).

* cited by examiner

*Primary Examiner* — Vit W Miska
(74) *Attorney, Agent, or Firm* — Oblon, McClelland, Maier & Neustadt, L.L.P.

(57) ABSTRACT

Method for attachment of a last outer coil of a timepiece balance spring inside a groove provided in a balance spring stud, wherein the method includes the step of adhesive bonding the last outer coil of the timepiece balance spring by means of a fluid adhesive whose viscosity is comprised between 200 and 400 mPa·s.

7 Claims, 2 Drawing Sheets

METHOD FOR ATTACHMENT OF A BALANCE SPRING FOR A MECHANICAL TIMEPIECE MOVEMENT AND BALANCE SPRING ATTACHED BY SUCH A METHOD

This application claims priority from European Patent Application No 16157390.2 of Feb. 25, 2016, the entire disclosure of which is hereby incorporated herein by reference.

FIELD OF THE INVENTION

The present invention concerns a method for attachment of a balance spring for a mechanical timepiece movement. The present invention concerns, in particular, a method for adhesive bonding of balance springs. The invention also concerns a balance spring attached by such a method.

BACKGROUND OF THE INVENTION

In the field of watchmaking, with the balance, the balance spring forms the time base of mechanical timepieces. The balance spring takes the form broadly of a very fine spring wound into concentric coils wherein a first end, called the first inner coil, is connected to a collet, and a second end, called the last outer coil, is connected to a balance spring stud.

More specifically, the oscillating system comprises a balance/balance spring pair and an escapement. The balance comprises a balance staff connected to a felloe by means of radial arms and pivoted between first and second bearings. The balance spring is attached via a first inner coil to the balance staff, for example, by means of a collet. The balance spring is attached via a last outer coil to an attachment point consisting of a balance spring stud, which may be carried by a stud-holder. The escapement comprises a double roller consisting of a roller that carries an impulse pin and a safety-roller in which is arranged a notch. The escapement also comprises a pallet-lever including a pallet staff pivoted between first and second bearings. The pallet-lever comprises a lever that connects a fork to an entry arm and an exit arm. The fork is formed of an entry horn and an exit horn between which extends a guard pin. The travel of the fork is limited by an entry banking-pin and an exit banking-pin which may be made in one-piece with a pallet-cock. The entry arm and the exit arm respectively carry an entry pallet and an exit pallet. Finally, the pallet-lever cooperates with an escape wheel comprising an escape wheel arbor pivoted between first and second bearings.

The material used to make balance springs is usually an alloy based on cobalt, nickel and chromium. Such an alloy is ductile and must be resistant to corrosion. Recent developments however, propose balance springs made of silicon. Silicon balance springs are more precise than their steel predecessors. However, their cost price is higher. On account of their small dimensions, such balance springs are, however, difficult to assemble.

The balance spring is an Archimedes spring, wound in the horizontal plane, which has only one function: once paired with a balance, it must turn in one direction, and then in the other direction, i.e. oscillate about its position of equilibrium. It is said to "breathe". Yet, everything conspires to prevent a balance spring from always oscillating at the same frequency. The balance spring must, in particular, be resistant to oxidation and to magnetism which causes the coils to stick to each other and stops the watch. The influence of atmospheric pressure is low. For a long time, temperature was the core of the problem, since heat expands metal and cold causes it to shrink. The balance spring must also be elastic in order to deform and yet always return to its shape.

Above all, the balance spring must be isochronous. Regardless of how far the balance spring turns, it must always take the same time to oscillate. If the balance spring is contracted by only a few degrees, it does not accumulate much energy and returns slowly to its position of equilibrium. If the balance spring is moved far away from its position of equilibrium, it moves very quickly in the opposite direction. What matters is that these two movements take the same amount of time. The underlying idea is that the energy available to the balance spring is not constant and yet despite this, it must operate regardless of whether the watch is completely wound or in its last hours of power reserve.

On account of their small dimensions, such balance springs are, however, difficult to assemble. Yet the manner in which the two ends of the balance spring are attached also has an enormous influence on the accuracy of the timepiece movement. In most mechanical timepiece movements, the two ends of the balance spring are inserted in a pierced element and are immobilised by means of a pin, force-fitted manually using pliers. This may result in a slight rotation of the balance spring, which is detrimental to the accuracy of the rate of the movement. To overcome this problem, in the 1960's, the French watch manufacturer Lip proposed the adhesive bonding of a balance spring with a dot of hot melt adhesive, i.e. an adhesive that is solid at room temperature, but melts under the action of heat.

However, even the technique consisting in bonding the end of balance springs by means of a hot melt adhesive has its limitations. Indeed, it was observed that, because of its viscosity, as it melts, hot melt adhesive exerts a traction force on the balance spring by capillary action and may press the balance spring end against the walls of the stud in which the end is engaged. The resulting deformation of the balance spring induces therein mechanical stresses which are very detrimental to the regularity of its rate.

SUMMARY OF THE INVENTION

It is an object of the present invention to overcome the aforementioned drawbacks in addition to others by providing a method for attachment of a balance spring that does not induce mechanical stresses in such a balance spring and does not move it away from its position of rest.

To this end, the present invention concerns a method for attachment of a last outer coil of a timepiece balance spring in a stud, this method comprising the step of bonding the last outer coil of the timepiece balance spring by means of a fluid adhesive whose viscosity is comprised between 200 and 400 mPa·s.

According to a complementary feature of the invention, the last outer coil of the balance spring is adhesive bonded inside a groove arranged in the stud.

According to another feature of the invention, the fluid adhesive can be cured by ultraviolet irradiation.

As a result of these features, the present invention provides a method for attachment of a timepiece balance spring in which the last outer coil of the timepiece balance spring is adhesive bonded to the stud by means of a drop of fluid adhesive. Thus, even if, at the moment that the drop of adhesive is deposited, for example by means of an automated adhesive dispenser, the free end of the last balance spring coil deforms slightly under the effect of the weight of the adhesive, which induces undesired mechanical stresses in the balance spring, prior to hardening, the adhesive is sufficiently fluid to enable the free end of the last balance spring coil to spontaneously return to its rest position. Stresses induced in the balance spring at the moment that the drop of adhesive is deposited therefore disappear by themselves, such that the regularity of rate of the balance spring is not affected by the operation to attach said spring.

The fluid adhesive may also be an adhesive that hardens on contact with the air.

The invention also concerns a balance spring for a timepiece movement formed of a winding of concentric coils and comprising a last outer coil that ends in a plate, which is thicker than the other coils of the balance spring, the plate being provided with at least one notch to promote the adhesion of the adhesive once the latter hardens.

BRIEF DESCRIPTION OF THE DRAWINGS

Other features and advantages of the present invention will appear more clearly from the following detailed description of an example implementation of the method according to the invention, this example being given purely by way of non-limiting illustration with reference to the annexed drawing, in which.

DETAILED DESCRIPTION OF AN EXAMPLE EMBODIMENT OF THE INVENTION

Figure 1A:
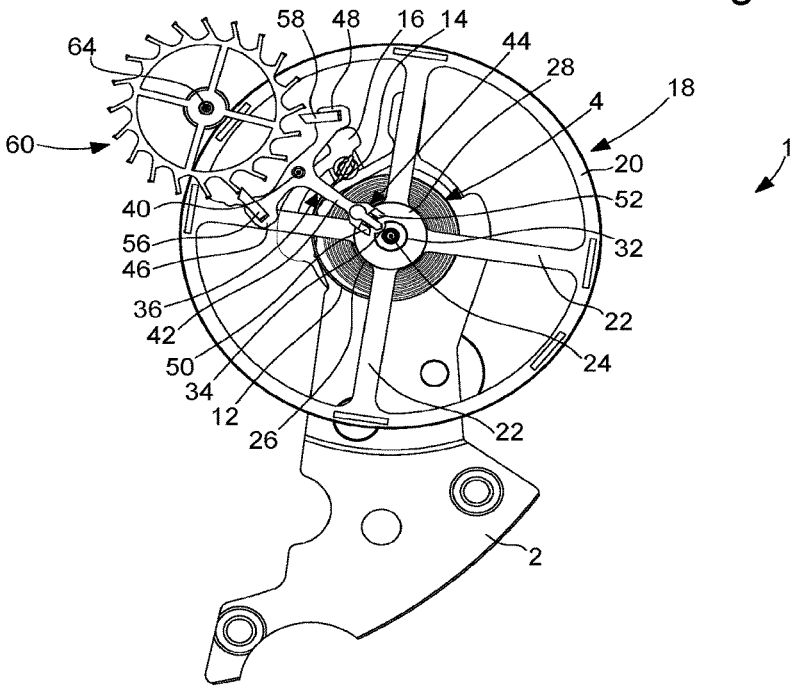
FIGS. 1A and 1B are general perspective views of an oscillating system for a timepiece movement to which the present invention applies.

The present invention proceeds from the general inventive idea that consists in adhesive bonding the last outer coil of a balance spring onto a balance spring stud by means of a fluid adhesive whose viscosity is comprised between 200 and 400 mPa·s. Indeed, it was observed that, when the last outer coil of the balance spring is adhesive bonded, for example by means of a hot melt adhesive, the viscosity of the adhesive is such that it exerts on the balance spring capillary forces that tend to move the balance spring away from its position of rest and to induce therein mechanical stresses which considerably hamper its rate accuracy. Conversely, with a sufficiently fluid adhesive, even if the balance spring moves away from its position of rest at the moment when the adhesive is deposited, the balance spring can spontaneously return to its position of rest free of any stress, before the adhesive hardens. Consequently, the rate accuracy of the balance spring is not affected by the operation that consists in the adhesive bonding thereof onto the stud.

According to a first variant embodiment of the invention, the adhesive used is a fluid adhesive that hardens on contact with the air. According to a second variant embodiment of the invention, the fluid adhesive is an adhesive that hardens by curing under the effect of exposure to ultraviolet irradiation.

A "photo-curable adhesive" means a polymeric adhesive capable of curing under the effect of ultraviolet irradiation. This is why photo-curable adhesives are usually designated by the term "UV adhesive". Photo-curable adhesives have a great number of advantages: they are one-part adhesives, quick to cure and may, in some cases, do so without solvent, they are easy to apply, can produce heat-sensitive bonding and have no pot life. "Pot life" means the period of time in which a resin can be used before complete hardening, starting from the moment when the two constituents of the resin are mixed, and the chemical reaction occurs.

Very broadly, a photo-curable adhesive consists of a base resin, a photo-activator and, if required, one or more additives.

The base resin, which may be a monomer or an oligomer, has well-defined functional groups which, after UV curing, will determine the physical and chemical properties of the resulting polymer. The curing reaction may be based either on radical mechanisms to which, for example, acrylic constituents are subjected, or on cationic mechanisms to which, for example, epoxy constituents are subjected. In the case of a radical reaction, the photo-curing ceases as soon as exposure to UV irradiation ends. Further, radical systems of the acrylic type are subject to oxygen inhibition. Conversely, in the case of a cationic reaction, the photo-curing continues even after UV irradiation stops and is not subject to oxygen inhibition. Further, it is possible to complete UV curing with a last heat curing step.

In the case of the present invention, we are concerned with curing reactions of both the radical and cationic type. To this end, the base resin may be selected from:

- epoxide compounds which comprise cycloaliphatic epoxides and glycidyl epoxides, vinyl ethers and electron-rich vinyl compounds;
- alcohols in combination with epoxide compounds, and
- acrylic compounds.

It will be noted that the alcohols and polyols both react with the epoxides and acrylics as chain transfer agents, generally improving the cure speed of the formulations. It will also be noted that cycloaliphatic epoxide resins produce a faster cationic curing reaction than glycidyl epoxide resins since they have higher chain flexibility than the latter.

In addition to a base resin, the UV adhesive composition is completed by a photoinitiator. A photoinitiator is a molecule that absorbs light and forms a reactive chemical species. These photoinitiator compounds generally produce a superacid that allows the cross-linking of cationic systems. These systems are therefore inhibited in a base or wet medium. However, they are not inhibited by the presence of oxygen. Conventional cationic photoinitiators are notably:

- diaryliodonium salts;
- triarylsulfonium salts;
- dialkylphenacylsulfonium salts.

These salts which react at short wavelengths (200-300 nm) may be used alone or in combination with photosensitizers, i.e. molecules capable of absorbing light and transferring the excitation to another molecule for greater efficiency.

Photoinitiators must have excellent reactivity, a suitable absorption spectrum, no yellowing, good stability, compatibility with monomers and substrates, minimum odor and be non-toxic.

The composition of a photo-curable adhesive may be completed by one or more additives, among which the following can be cited: coinitiators, i.e. molecules that do not participate in light absorption but which contribute to the production of reactive particles, antioxidants, UV stabilizers, reactive diluents, or adhesion promoters or surface active agents.

Figure 1B:
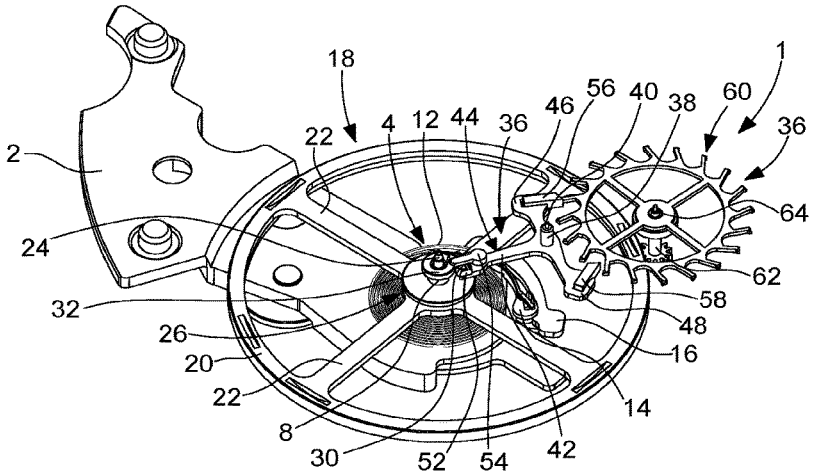
Figure 2A:
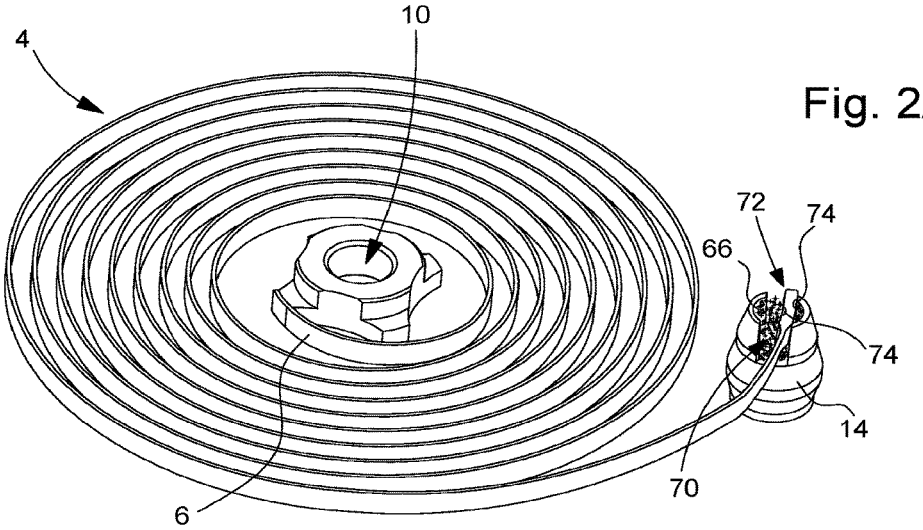
FIGS. 2A and 2B schematically illustrate a balance spring whose outer end is bonded to a stud by means of a light-curable adhesive.
Figure 2B:
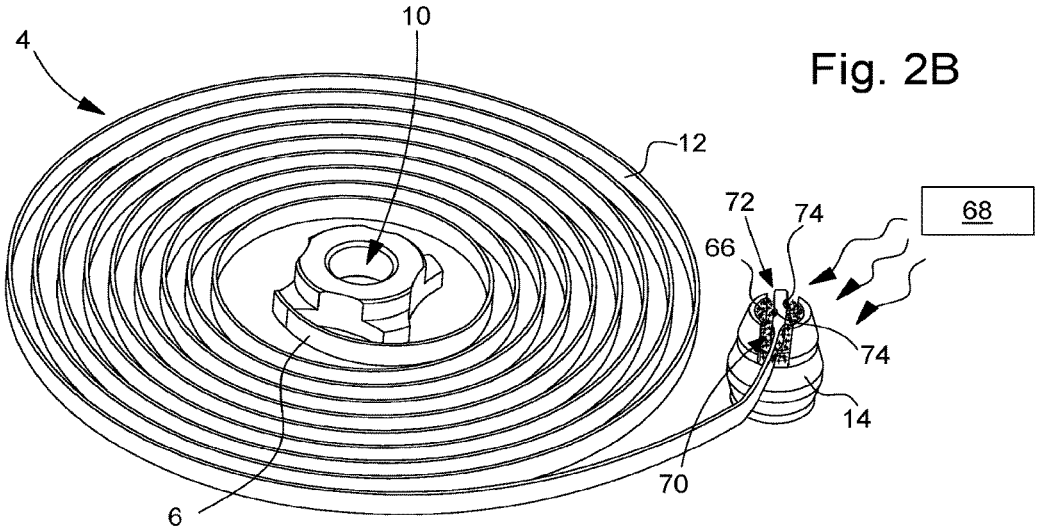
Figure 3:
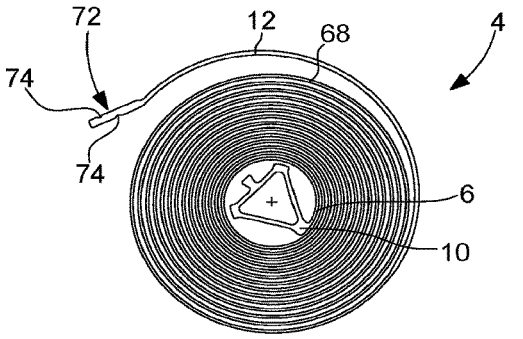
FIG. 3 is a view of a timepiece balance spring whose last outer coil ends in a plate that is thicker than the other coils of the balance spring and in which are provided notches to promote the adhesion of the adhesive.

An example embodiment of the invention is illustrated in FIGS. 1A and 1B annexed hereto. These Figures represent an oscillating system for a timepiece movement designated as a whole by the general numeral reference 1. Oscillating system 1, mounted on a bridge 2 of the main plate of a timepiece movement, comprises a timepiece balance spring 4 formed of a very fine spring wound in concentric coils and which is attached via a first inner coil 6 (FIGS. 2B and 3) to a balance staff 8 by means of a collet 10 (FIGS. 2A, 2B and 3). Balance spring 4 is attached via a last outer coil 12 at an attachment point formed by a balance spring stud 14 carried by a stud holder or balance-cock 16.

Oscillating system 1 also comprises a balance 18 whose staff 8 is connected to a felloe 20 by means of radial arms 22. Balance staff 8 is pivoted between first and second bearings 24, only one of which is visible in the drawing, and which are pressed into bridge 2 and the main plate of the timepiece movement.

Further, oscillating system 1 comprises a double-roller 26 formed of a roller 28 that carries an impulse pin 30 and a safety-roller 32 in which is provided a notch 34.

The oscillating system finally comprises a pallet-lever 36 with staff 38 which is pivoted between first and second pivots 40, only one of which is visible in FIGS. 1A and 1B. Pallet-lever 36 consists of a lever 42 that connects a fork 44 to an entry arm 46 and to an exit arm 48. Fork 44 is formed of an entry horn 50 and an exit horn 52 between which extends a guard pin 54. The travel of fork 44 is limited by an entry banking pin and an exit banking pin (not visible in the drawing) which may be made in one-piece with a pallet-cock. Entry arm 46 and exit arm 48 respectively carry an entry pallet 56 and an exit pallet 58.

Finally, pallet-lever 36 cooperates with an escape wheel 60 comprising an arbor 62 of escape wheel 60 pivoted between first and second pivots 64.

According to the embodiment of the invention illustrated in FIGS. 2A and 2B, last outer coil 12 of balance spring 4 is adhesive bonded to stud 14 by means of a drop of photo-curable adhesive 66. This drop of adhesive is, for example, deposited by means of an automated dispensing device, such as a dispenser. The drop of photo-curable adhesive 66 is cured by exposure to light irradiation produced by an ultraviolet light source 68. Exposure to ultraviolet light is sufficient to cause complete curing of the adhesive. It will be noted that first inner coil 6 of balance spring 4 may also be bonded to collet 10 by means of the same conductive UV adhesive that the one employed for bonding balance spring 4 to stud 14.

As revealed by an examination of FIGS. 2A and 2B, last outer coil 12 of balance spring 4 is disposed in a groove 70 provided at the upper end of stud 14. In FIG. 2A, the drop of photo-curable adhesive 66 has been deposited using a dispenser and, under the effect of the projection force of the adhesive, the end of last outer coil 12 of balance spring 4 has moved slightly away from its position of rest and is touching the walls of groove 70, which is very detrimental to the rate accuracy of the balance spring. However, as seen in FIG. 2B, before the adhesive cures, the end of last outer coil 12 of balance spring 4 has spontaneously returned to its position of rest. This is made possible by the fact that photo-curable adhesive 66 is very fluid, its viscosity being comprised between 200 and 400 mPa·s, such that the adhesive does not resist the spontaneous return movement of the end of balance spring 4 to its position of equilibrium. Consequently, the operation to attach balance spring 4 does not induce any mechanical stress in balance spring 4, which is very favourable for the rate accuracy of the latter.

According to another feature of the invention, last outer coil 12 of balance spring 4 ends in a plate 72 made in one-piece with the end of last outer coil 12 and which is thicker than the other coils of balance spring 4. Purely by way of example, the cross-section of the plate is 0.1×0.1 $mm^2$ and its length L is 0.6 millimeters. It will also be observed that plate 72 is provided with at least one and, preferably, with two notches 74 to promote the adhesion of the adhesive once the latter has hardened. Finally, it will be observed that last outer coil 12 is not concentric with the other coils of balance spring 4. Last outer coil 12 moves away slightly from the centre of balance spring 4 so that the penultimate coil 68 that precedes it does not touch stud 14.

It goes without saying that the present invention is not limited to the embodiments that have just been described and that various simple modifications and variants can be envisaged by those skilled in the art without departing from the scope of the invention as defined by the annexed claims. It will be understood, in particular, that according to another variant embodiment of the invention, last outer coil 12 of balance spring 4 may be bonded to stud 14 by means of a drop of adhesive that hardens on contact with the air. The material used to make balance springs is usually an alloy based on cobalt, nickel and chromium. Such an alloy is ductile and must be resistant to corrosion. Recent developments however, propose balance springs made of silicon. Silicon balance springs are much more accurate than their steel predecessors. However, their cost price is substantially higher than that of steel balance springs. The term "silicon balance spring" means a balance spring made of a material including single crystal silicon, doped single crystal silicon, polycrystalline silicon, doped polycrystalline silicon, porous silicon, silicon oxide, quartz, silica, silicon nitride or silicon carbide. Of course, when the silicon-based material is in crystalline phase, any crystalline orientation may be used.

NOMENCLATURE

1. Oscillating system
2. Bridge
4. Timepiece balance spring
6. First inner coil
8. Balance staff
10. Collet
12. Last outer coil
14. Balance spring stud
16. Stud-holder or balance-cock
18. Balance
20. Felloe
22. Radial arms
24. First and second bearings
26. Double-roller
28. Roller
30. Impulse pin
32. Safety roller
34. Notch
36. Pallet-lever
38. Staff
40. First and second pivots
42. Lever
44. Fork
46. Entry arm
48. Exit arm
50. Entry horn
52. Exit horn
54. Guard pin
56. Entry pallet
58. Exit pallet
60. Escape wheel
62. Arbor
64. First and second pivots

66. Photo-curable adhesive
68. Ultraviolet light source
70. Groove
72. Plate
74. Notches

What is claimed is:

1. A Method for attachment of a last outer coil of a timepiece balance spring in a balance spring stud, wherein the method includes the step of adhesive bonding the last outer coil of the timepiece balance spring by means of a fluid adhesive whose viscosity is comprised between 200 and 400 mPa·s.

2. The method according to claim 1, wherein the last outer coil of the timepiece balance spring is adhesive bonded inside a groove provided in the balance spring stud.

3. The attachment method according to claim 1, wherein the fluid adhesive is cured by means of ultraviolet irradiation.

4. The attachment method according to claim 2, wherein the fluid adhesive is cured by means of ultraviolet irradiation.

5. The attachment method according to claim 1, wherein the fluid adhesive is an adhesive that hardens on contact with the air.

6. The attachment method according to claim 2, wherein the fluid adhesive is an adhesive that hardens on contact with the air.

7. A balance spring for a timepiece movement formed of a winding of concentric coils and comprising a last outer coil attached in a balance spring stud by the method according to claim 1, wherein the last outer coil ends in a plate which is thicker than the other coils of the balance spring, wherein the plate is provided with at least one notch to promote the adhesion of the fluid adhesive once the latter has hardened.

* * * * *